US005336017A

United States Patent [19]

Nichols

[11] Patent Number: 5,336,017

[45] Date of Patent: Aug. 9, 1994

[54] LEACHING SYSTEM CONDUIT WITH INTERLOCKING END JOINT

[75] Inventor: James M. Nichols, Old Saybrook, Conn.

[73] Assignee: Infiltrator Systems, Inc., Old Saybrook, Conn.

[21] Appl. No.: 893,555

[22] Filed: Jun. 3, 1992

Related U.S. Application Data

[63] Continuation of Ser. No. 694,880, May 2, 1991, abandoned, which is a continuation of Ser. No. 341,902, Apr. 24, 1989, Pat. No. 5,017,041.

[51] Int. Cl.[5] ..... E02B 11/00

[52] U.S. Cl. ..... 405/46; 405/43; 405/49; 405/50

[58] Field of Search ..... 405/36, 43, 44, 45, 405/46, 47, 48, 49, 50; 403/339, 340, 345; 285/330, 331

[56] References Cited

U.S. PATENT DOCUMENTS

| | | | |
|---|---|---|---|
| 980,442 | 1/1911 | Schlafly | 405/48 |
| 1,541,918 | 6/1925 | Brennan | 405/48 |
| 2,153,789 | 4/1939 | Carswell et al. | 405/48 |
| 4,360,042 | 11/1982 | Fouss et al. | 405/49 X |
| 4,759,661 | 7/1988 | Nichols et al. | 405/48 |
| 4,790,567 | 12/1988 | Kawano et al. | 285/330 X |
| 5,017,041 | 5/1991 | Nichols | 405/48 |
| 5,087,151 | 2/1992 | DiTullio | 405/43 |

OTHER PUBLICATIONS

Pallet-Crate Sketch, Unknown Author, Uknown Publication Date, (1) page.

*Primary Examiner*—Randolph A. Reese
*Assistant Examiner*—J. Russell McBee
*Attorney, Agent, or Firm*—C. G. Nessler

[57] ABSTRACT

A conduit for dispersing or gathering liquids in the earth has an arch shape cross section and alternating peak and valley corrugations along its length, with cantilever legs extending from one end to interact with the mating portion of a like conduit. The legs, along with a shiplap joint having flange discontinuities for manufacturability, provide a superior rigid joint when the conduits are mated and buried beneath the earth and subjected to vertical loads.

7 Claims, 3 Drawing Sheets

LEACHING SYSTEM CONDUIT WITH INTERLOCKING END JOINT

This application is a continuation of copending application Ser. No. 07/694,880, filed May 2, 1991, now abandoned, which was a continuation of Ser. No. 07/341,902, filed on Apr. 24, 1989 now U.S. Pat. No. 5,017,041.

TECHNICAL FIELD

The present invention relates to the dispersion or collection of liquids within the earth, more particularly, to the construction of joints between arch shaped conduits for such purpose.

BACKGROUND

The present invention is an improvement on arch shaped leaching system conduits of the type described in U.S. Pat. No. 4,759,661, issued on Jul. 26, 1988 to James M. Nichols (the inventor herein) and Randall C. May, the disclosure of which is hereby incorporated by reference. The patented unit is characterized by a special sidewall construction which enables a conduit to be buried directly in the earth, providing a functionality equal to traditional perforated pipe and gravel installations, but with the avoidance of the cost and bother of surrounding gravel. The unit has enjoyed significant commercial success since its introduction to the public.

As the foregoing patent shows, the leaching system conduits are intended to be buried in the earth where they may receive liquids for dispersion. For instance, they can receive the effluent from a septic tank. Typically, the units by design are connected serially to each other by a shiplap joint, to achieve the desired subterranean dispersion area. Typically, the liquid being dispersed is introducted into the first end of an arch conduit series by a circular sewer pipe. Sometimes, spaced apart series of units are interconnected by circular sewer pipe.

For economic reasons, the units are made identical. Thus each has provision for a circular sewer pipe connection, an overlapping shiplap end and a corresponding overlapped shiplap end. End closures, essentially fitted plates, are used to make conduits with blind, or terminal, ends.

One of the desired features of the conduit is its ability to support heavy vertical loads, such as are applied by heavy motor vehicles passing across the surface of the earth within which the units are buried. To achieve this economically, the arch shaped conduit is typically made of a strong molded plastic and has special tapered corrugations along its length as shown in the patent.

The corrugations are special in that they enable nesting of the units, while still enabling the structural and liquid dispersal functions of the unit. At each opposing end of the unit there are valleys of approximately identical configuration which enable shiplap joint connection to similar units. Because of the structural discontinuity inherent at the shiplap joint the structure is somewhat weaker than desired despite the adjacent corrugations.

Another contribution to weakness at the joint region involves the provision for connection of the circular sewer pipe. The pipe is desirably connected to a unit at the uppermost elevation, i.e., the elevation of a peak of the corrugation. As shown in the patent, this necessitates a raised essentially sub-arch portion running transverse to the valley length at each end. When units are mated one to the other, the sub-arch shapes mate in shiplap fashion as do the main arch shapes of the ends. But, while the prior art configuration is effective in allowing the proper introduction of liquids into the arch, there is a weakening interruption of the web connecting the end valley with the peak of the adjacent corrugation.

Consequently, there is a tendency in the prior art unit for unwanted deflection of the joint region under severe loads. Because of the need to nest the units for economic shipping it is not feasible to build consequential internal stiffening. There has been a need for improvements in the construction which are both effective and suitable for economic construction.

Others have made somewhat similar arch shape units, in the past and presently. But these units have either been characterized by open ends, without particular closure, without shiplap, or with permanently closed ends where the inlet pipe enters relatively low down from the peak. Consequently, the problems described above have not been resolved heretofore.

DISCLOSURE OF THE INVENTION

An object of the invention is to provide an improved arch shape conduit, one in which the region at the joints of adjacent units are both able to be well connected, as in the prior art shiplap configuration, but with improved strength. A further object of the invention is to provide such improved arch shape conduit in a form which enables a circular sewer pipe to be connected at the uppermost portion of the arch end, when such is desired by the user.

In accord with the invention, a corrugated arch shape cross section conduit, with opposing overlapping and overlapped ends, has one or more cantilevered legs extending lengthwise from the an end, to form with the end a female pocket like space in which is received the end of a mating conduit. In an embodiment of the invention, the ends of adjacent conduits mate in shiplap fashion and the conduit end where the legs are is discontinuous. The legs may be applied to the overlapped or overlapping end, and they work well independently or in cooperation with a sub-arch at the top of the arch, where the sub-arch is adapted to receive a pipe bringing liquid to the conduit.

The shiplap interconnection, the multiple legs, and special sub-arch structure, when used, cooperate to intertransfer loads and impart great rigidity to interconnected conduits. The shiplap ends and general construction are suited for the purpose of preventing egress of dirt and the like when the units are buried in the earth. The invention is suitable for low cost manufacture by plastic molding processes and imparts heightened utility to the previously patented invention.

The foregoing and other objects, features and advantages of the invention will become more apparent from the following description of the best mode of the invention and accompanying drawings.

BEST MODE FOR CARRYING OUT THE INVENTION

The preferred embodiment of the invention is described in terms of an arch shape conduit which is described and shown in the aforementioned U.S. Pat. No. 4,759,661, hereby incorporated by reference. The present invention will be also useful with other particular configurations of conduit. It will be generally useful for arch-shaped conduits suited for burial and interconnection within the earth.

Figure 1:
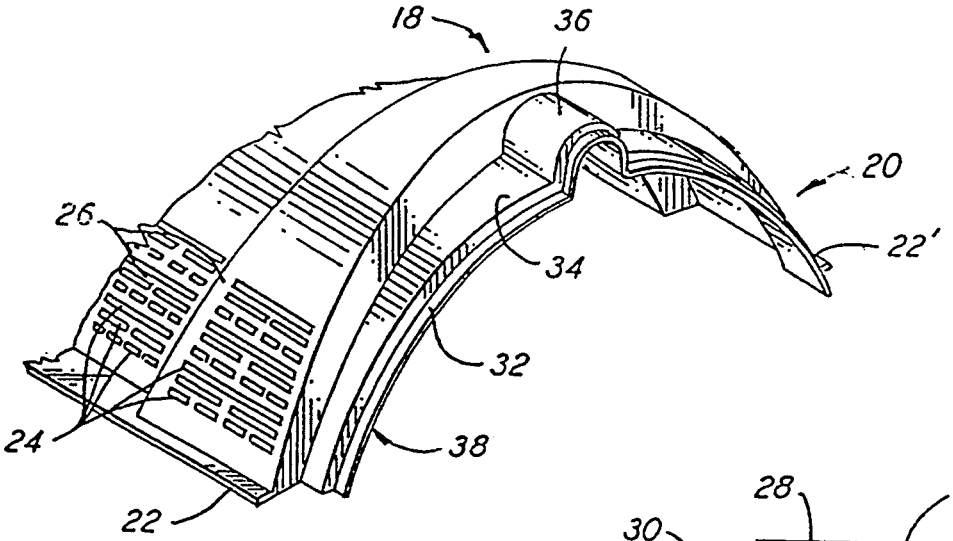
FIG. 1 Prior Art
FIG. 1 shows an arch shape conduit of the prior art.
Figure 2:
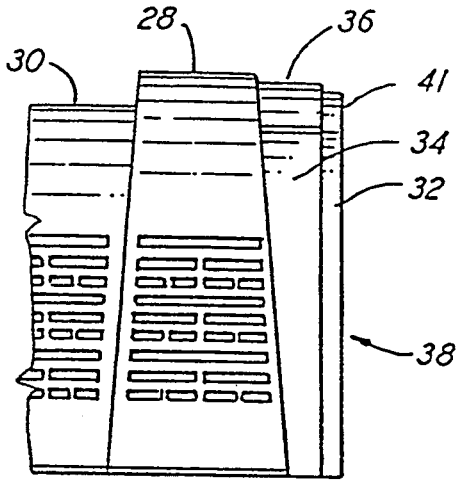
FIG. 2 Prior Art
FIG. 2 is a side view of the device of FIG. 1.

FIG. 1 shows a fragment of the prior art device. FIG. 2 shows the same device in a side view. The conduit 20 is in the shape of an inverted trough. It has a top 18 when put in its working position and flanged base parts 22, 22'. There are a multiplicity of slots 24 or other kinds of perforations through the side walls 26. The conduit has corrugations along its length, running transverse to its length. The corrugations are comprised of alternating raised peaks 28 and depressed valleys 30. The two ends of the unit are valleys and are respectively overlapping and overlapped. The ends are adapted to shiplap corresponding overlapped and overlapping ends of adjoining like units. If cut in two, the opposing ends of a single conduit would mate with each other.

Figure 3:
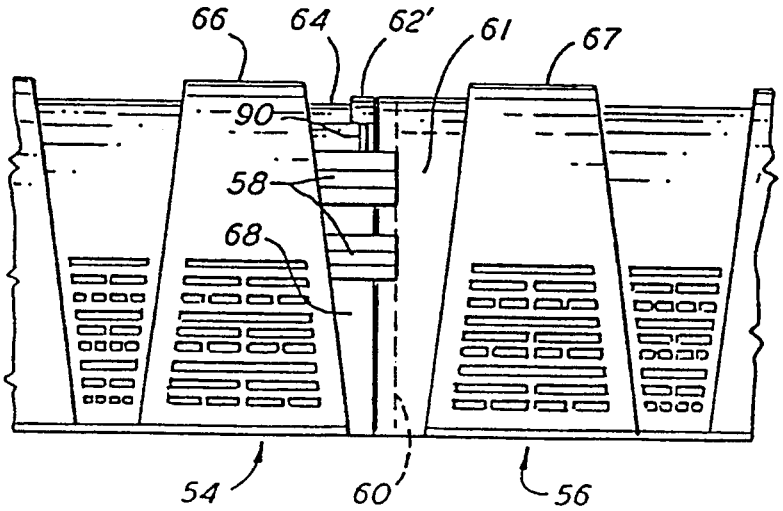
FIG. 3 shows two interconnected units of the present invention.
Figure 11:
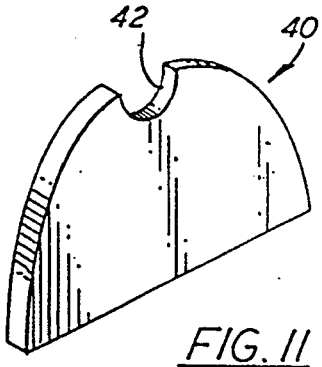
FIG. 11 shows an end closure for a conduit.

In FIGS. 1 and 2 the overlapped end 38 is shown. It is characterized by the overlapped flange part 32 of the end valley 34. The overlapped flange part slips inside a mating part's overlapping valley end, as illustrated by FIG. 3. At the peak of the overlapped valley arch of FIGS. 1–2 is a sub-arch 36, which is essentially a semicircle, and has its own overlapped shiplap flange part 41. This sub-arch portion forms part of a circular sewer pipe receptacle when the end 38 is mated with a suitable closure 40, such as shown in FIG. 11, having a semi-circular cut out 42. The top of the sub-arch is such that the sewer pipe top will be nominally level with the top of the adjacent peak corrugation.

Figure 13:
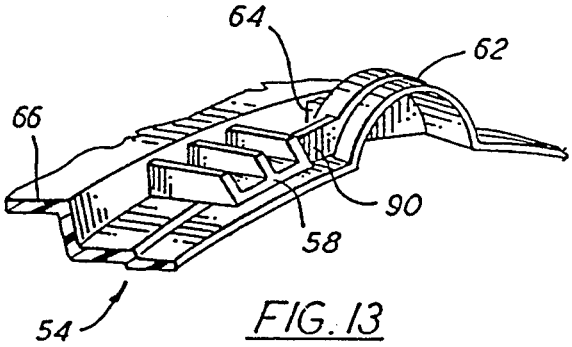
FIG. 13 shows a structure connecting a cantilever leg to a sub-arch.

FIG. 3 shows how two like units of the present invention interconnect. The conduits have parts corresponding to those just described. In the best mode of the improvements of the present invention there are legs 58 and there is a sub-arch 62 which is spaced apart from the nearest peak corrugation 66. There is structure, being webs, connecting the sub-arch to the legs on either side of it, and like structure connecting the sub-arch to the continous web of the adjacent peak corrugation. Such structure is shown in more detail in FIG. 13.

Figure 5:
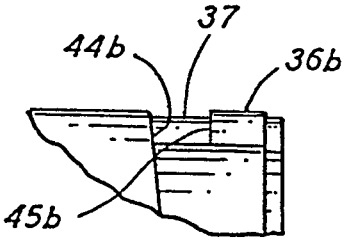
FIG. 5 shows a web connecting a sub-arch to the web of the adjacent corrugation peak.
Figure 4:
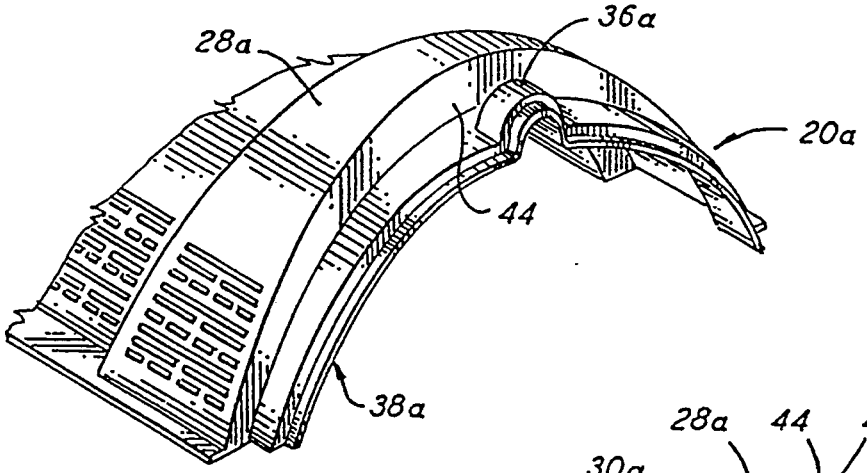
FIG. 4 shows a sub-arch at a valley corrugation end, with a closed end spaced apart from the adjacent peak corrugation.
Figure 6:
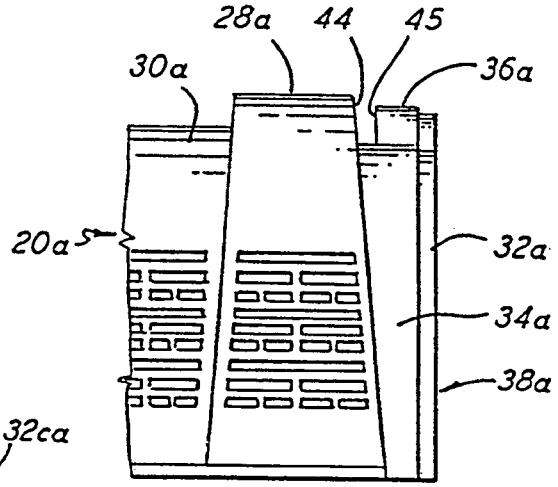
FIG. 6 is a side view of the device of FIG. 4.

FIGS. 4–6 correspond with FIGS. 1 and 2, and show the improved sub-arch construction on the overlapped end of conduit 20*a*. Parts of the conduit 20*a* correspond with those just described for the conduit 20; they are numbered similarly but with a suffix. As FIGS. 4 and 6 show the web 44 of the peak corrugation 28*a* adjacent the valley end is made continuous.

Preferably, the sub-arch 36*a* is spaced apart from the peak corrugation 28*a* and has a closed end 45. FIG. 5 shows a small sub-arch web 37, which runs lengthwise along the conduit, connecting the corrugation peak web 44 with the end 45*b* of the sub-arch 36*b*, thus providing further stiffness. Preferrably, there are two sub-arch webs running parallel. Other structure may be substituted.

Figure 12:
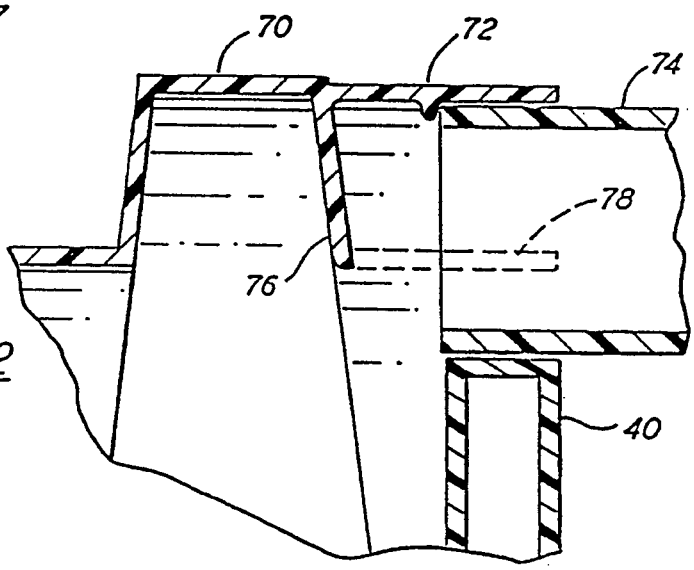
FIG. 12 shows a sub-arch having a closed end which is a portion of the web of the adjacent peak corrugation.

FIG. 12 shows in cross section another sub-arch construction which carries out the purpose of the invention. The sub-arch 72 runs along the top of the valley corrugation (indicated by the dashed lines 78) to the web 76 of the adjacent peak corrugation 70; the web acts as the closure of the sub-arch. A sewer pipe 74 is shown in the receptacle formed by the arch end closure 40 and the sub-arch 72.

Figure 7:
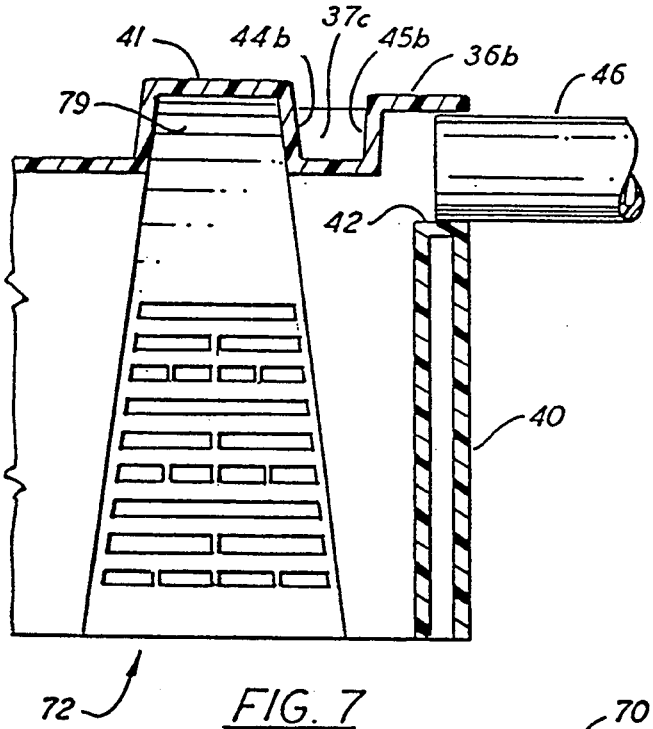
FIG. 7 shows a longtitudinal plane cross section of a conduit like those of FIGS. 4–6, where the end closure of FIG. 11 is in place and a sewer pipe connected into the receptacle formed by the end closure and sub-arch.

FIG. 7 shows a lengthwise centerplane cross section of a conduit 72 having a sub-arch 36*b* and a sub-arch web 37*c*. It also has a double walled end closure 40, like that shown in FIG. 10. A sewer pipe pipe 46 is shown slipped into the circular cavity formed by the semi-circle of the sub-arch 36*c* and the semi-circle 42 of the closure. Also shown is a portion of an egg-crate like webbing 79, interior of the peak corrugation 41, to further provide for transfer of loading in the structure.

Figure 10:
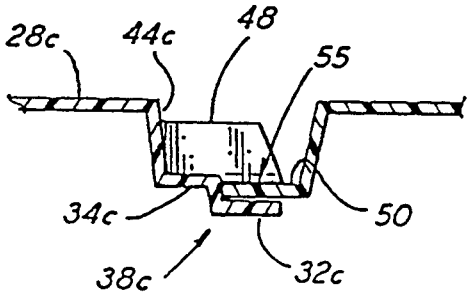
FIG. 10 is a cross section of the mated conduit joint of FIG. 9.

FIGS. 8–10 and FIG. 4 show cantilever legs which cooperate with the shiplap joints of mating conduits. As FIG. 10 shows, the leg 48 is thicker than the adjacent conduit wall parts 28*c*, 32*c*, and 34*c*; and, it's cross section is better shaped than the wall to resist and transfer transverse loads which are applied to the wall in use, as described below. The leg 48 has an E-shape cross section when viewed from the end of the conduit, being comprised of three webs and a connecting plate. This configuration is preferred for strength and injection molding; other leg configurations may be chosen. As will be seen, multiple legs, equally divided between each side of the arch are preferred, even though most of the description here is in term of one leg only.

Figure 8:
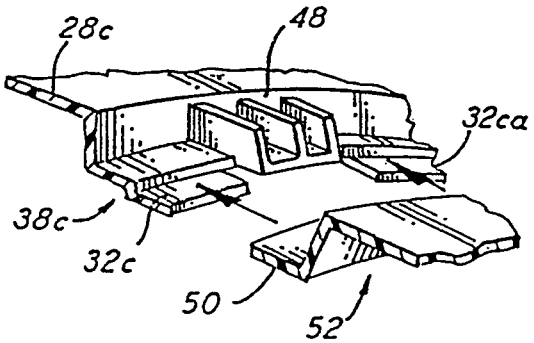
FIG. 8 shows the opposing ends of two conduits as they are being proximately mated, with a cantilever leg on the overlapped conduit end.
Figure 9:
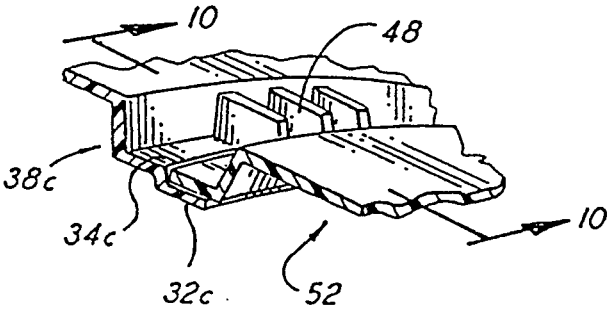
FIG. 9 is similar to FIG. 8 except that the conduits are mated.

FIG. 8 shows how an overlapped valley end 38*c* with a mating overlapping valley end 52 positioned for engagement. FIG. 9 shows the same parts in engagement. FIG. 10 shows a cross section through the mated joint of FIG. 9.

In FIGS. 8–10 the overlapped end 38*c* has a flange 32*c* which is adapted to be shiplapped by the overlapping valley 50 of the opposing end 52 of a mating unit. (The use of a flange parts on either end may be dispensed with by instead having different but congruent arch shapes at the opposing ends. With the use of the flange the mating units form a even surfaced valley when mated.) The leg 48 extends along the conduit length. It crosses the overlapped end valley 34*c* and ties into the web 44*c* of the peak corrugation for strength. When conduits are mated, the leg 48 overlays and engages the exterior surface of the valley 50 of the overlapping end 52, capturing it in a female pocket 55. When there are multiple legs, the female pockets may be visualized from FIGS. 8 and 10 as being segments of the hypothetical annular female space defined by the bottom contour of the leg 48 surfaces and the upper surface of the flange 32*c*.

From FIG. 10 the advantage of this part of the invention will be appreciated. When there is a load on the peak corrugation 28*c* or the valley 34*c* of the overlapped end of the conduit, instead of sagging under the load, the load is shared with the mated overlapping end of the adjacent unit.

As shown in FIG. 8, in the preferred mode, where the unit is made by molding plastic, the overlapped flange 32*c*, is discontinuous or absent in the immediate vicinity of the leg 48. Doing this increases the fabricability of the design while still carrying out the essential principle of the invention. Thus, reference herein to a female pocket like space will be understood to include within such a configuration wherein the legs are, as in FIG. 8, offset with respect to the parts of the discontinuous flange and there is no literal pocket.

Figure 14:
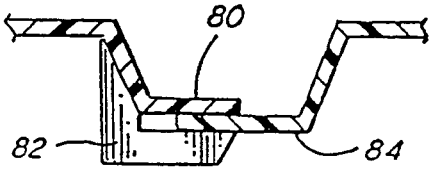
FIG. 14 shows a cantilever leg extending from the interior of the arch of an overlapping end, as it mates with the overlapped end of a mating conduit.

A leg 82 may also be used on the overlapping end 80 of a conduit as shown in FIG. 14. The leg will be on the interior or, underside of the end of the conduit. An overlapped end 84 of a mating conduit is shown in the Figure, in the cavity.

FIG. 3 shows in side view two conduits 54, 56 mated together as they will be when buried in the earth to disperse or collect liquids, with the best combination of features. They are held together by a small molded locking tang in the overlapped part which elastically engages a detent in the mating part, and screws and rivets may be used as well. The arch shape is preferrably a flattened arch. Conduit 54 is the overlapped unit of the two. The dotted line 60 indicates the extension of the overlapped flange of conduit 54 which is captured within the valley end 61 of the overlapping conduit 56. Of course, the overlapping is important to keep dirt and the like from entering the unit. Two legs 58 are visible in on the opposing (unshown) side of the conduit. The legs will best be placed near the upper or top portion of the valley arch of the overlapped conduit 54. As shown, the legs preferably will extend lengthwise the same distance as the amount of overlap. The web structures 64, 90 are shown in more detail in the fragment of conduit 54 shown in FIG. 13. Web 90 interconnects the sub-arch to the adjacent leg. Web 64 connects the sub-arch to the peak corrugation 66.

When a set of connected units as shown in FIG. 3 is vertically loaded from above, e.g., when there is earth pressure such as would be created by a vehicle passing over the earth surface above a buried unit, there are vertically downward loads on the corrugation peaks and the valley having the joint. The sub-arch and associated structures and the legs cooperatively tend to transfer the load back to the peak corrugations 66, 67. The continuous web of the peak corrugation 66 gives better rigidity than in the older articles. There is still a tendency for the overlapped web to bend downward; and the legs help resist this by transfering load to valley of the mating part 56 and its webbed peak corrugation 67. Thus, the several elements cooperatively provide superior strength, so that the joint may be practically as rigid as the conduit is away from the joints.

Although only the preferred embodiment has been described with some alternatives, it will be understood that further changes in form and detail may be made without departing from the spirit and scope of the claimed invention. For example, as described, the legs may be applied to overlapping ends. The legs may be applied to conduits where the mating ends are peak corrugations. Similarly, the continuous web and sub-arch features might be applied to both overlapped and overlapping ends, and to mating ends which are peak corrugations.

I claim:

1. A conduit for burial in the earth to disperse or gather liquids therein, having a wall shaped as an arch; the conduit having an open base and alternating peak corrugations and valley corrugations along its length, with the top of the device during use being the top of the arch; an overlapped end and an opposing overlapping end, the ends adapted to mate in shiplap fashion with the corresponding overlapping and overlapped ends of like devices; characterized by a cantilevered leg attached to and extending from one end, running parallel to the length of the conduit; the leg having a thickness greater than the thickness of the wall and a cross section shaped to provide greater resistance to force applied transverse to the wall than the resistance provided by the wall; the leg forming with the adjacent portions of said one end a female pocket like space, to receive therein a portion of the end of a mating conduit and to transfer vertical forces to and from the mating conduit and decrease the tendency of mating conduits to separate and deflect at their mating joint under vertical forces.

2. The conduit of claim 1 characterized by said one end which is a valley corrugation.

3. The conduit of claim 2 characterized by said one end being the overlapped end; and, the leg attached to the upper surface of the end.

4. A conduit for burial in the earth to disperse or gather liquids therein, having a wall shaped as an arch; the conduit having an open base and alternating peak corrugations and valley corrugations along its length, with the top of the device during use being the top of the arch; an overlapped end and an opposing overlapping end, the ends adapted to mate in shiplap fashion with the corresponding overlapping and overlapped ends of like devices; characterized by a cantilevered leg attached to and extending from one end, running parallel to the length of the conduit; said one end being discontinuous in the immediate vicinity of the leg; the leg having a thickness greater than the thickness of the wall and a cross section shaped to provide greater resistance to force applied transverse to the wall than the resistance provided by the wall; the leg forming with the adjacent portion of said one end a female pocket like space, to receive therein a portion of the end of a mating conduit and to transfer vertical forces to and from the mating conduit and decrease the tendency of mating conduits to separate and deflect at their mating joint under vertical forces; the opposite end of the conduit being identical to the end of the mating conduit which is receivable in the pocket-like space, having a shiplaping portion to close over the one end discontinuous portion near the leg, to prevent the ingress of earth to the interior of the conduit.

5. The conduit of claim 4 characterized said one end which is a valley corrugation.

6. The conduit of claim 5 characterized by said one end being the overlapped end; and, the leg attached to the upper surface of the end.

7. A pair of mated conduits for burial in the earth to disperse or gather liquids therein, each having a wall shaped as an arch; the conduit having an open base and alternating peak corrugations and valley corrugations along its length, with the top of the device during use being the top of the arch; the first conduit having an overlapped end and the second conduit having a mating overlapping end, the ends mated in shiplap fashion; the first conduit having multiple cantilevered legs attached to and extending from its overlapped end, running parallel to the length of the conduit; each leg having a thickness greater than the thickness of the first conduit wall and a cross section shaped to provide greater resistance to force applied transverse to the first conduit wall than the resistance thereto provided by the first conduit wall; the first conduit overlapped end being discontinuous in the immediate vicinity of each leg; each leg forming with the adjacent portions of the first conduit overlapped and a female pocket-like space in which is interlocked the overlapping end of the second conduit; the interlocking of shiplap and legs transferring vertical forces to and from each of the mated conduits to decrease the tendency of the mated conduits to separate and deflect at their mating joint under vertical forces; the overlapping end of the second conduit closing over the first conduit end discontinuous portions, to prevent the egress of earth into the interior of the arch shape when the conduits are buried in the earth.

* * * * *